US005248138A

United States Patent [19]

Frank

[11] Patent Number: 5,248,138

[45] Date of Patent: Sep. 28, 1993

[54] SHEET SUPPLY TRAY

[75] Inventor: Nick Frank, London, England

[73] Assignee: Xerox Corporation, Stamford, Conn.

[21] Appl. No.: 14,601

[22] Filed: Feb. 8, 1993

[30] Foreign Application Priority Data

Feb. 19, 1992 [GB] United Kingdom ..... 9203478

[51] Int. Cl.[5] ..... B65H 1/00

[52] U.S. Cl. ..... 271/171

[58] Field of Search ..... 271/171, 144, 223, 145, 271/241

[56] References Cited

U.S. PATENT DOCUMENTS 4,030,725 6/1977 Fukui et al. ..... 271/171 X
4,786,042 11/1988 Stemmle ..... 271/171 X
5,026,039 6/1991 Kuzuya et al. ..... 271/145 X

FOREIGN PATENT DOCUMENTS 3-106734 5/1991 Japan ..... 271/145

*Primary Examiner*—David H. Bollinger

[57] ABSTRACT

A sheet supply tray (31) having two walls (33,34) extending in parallel with the direction from which the sheets are extracted from the tray (31) seriatum, the two walls (33,34) being spaced an adjustable distance apart to accommodate sheets of different widths. One wall (34) of the tray (31) comprises a longitudinally-extending area from which resilient bristles (73) project, the free ends of the bristles (73) pointing in the sheet-extraction direction so as to provide a resilient cushion acting on the adjacent sheet edges so to bias the sheets against the opposing wall (33), to remove any skew therefrom.

11 Claims, 2 Drawing Sheets

SHEET SUPPLY TRAY

The present invention relates to a sheet supply tray, or cassette, for use in a sheet feeding apparatus and more particularly, but not exclusively, to a sheet feeding apparatus for use in an automatic reproducing machine, for example, a xerographic copier or printer.

A conventional sheet feeding apparatus for a xerographic copier is adapted to feed individual sheets successively from a stack, supported in a supply tray, to a suitable mechanism which is to operate on the sheets. To enable the sheet feeding apparatus to feed sheets of a wide range of sizes from the supply tray to a sheet feed path within the copier, without skewing, the supply tray is provided with sheet side guides which can be adjusted to suit the width of each stack of sheets to be fed. However, many of the sheet side guide mechanisms are complex and costly. Other adjusting mechanisms are adjustable to only a limited number of positions whilst others require a large amount of operator time and/or care to complete the adjustment procedure.

It is an object of the present invention to provide a sheet feeder which is of simple design and construction, easy to operate, efficient and reliable in operation and economical to manufacture.

Accordingly, the present invention provides a sheet supply tray having two walls extending in parallel with the direction from which the sheets are extracted from the tray seriatum, the two walls being spaced an adjustable distance apart to accommodate sheets of different widths, characterized in that one wall comprises a longitudinally-extending area from which resilient bristles project, the free ends of the bristles pointing in the sheet-extraction direction so as to provide a resilient cushion acting on the adjacent sheet edges so as to bias the sheets against the opposing wall, to remove any skew therefrom.

In one embodiment the bristles are more than 2 mm in length, and in a preferred embodiment are at least 10 mm in length.

In one embodiment the bristles are woven into a backing member attached to said one wall of the tray. Conveniently, the backing member is a cloth with nylon bristles woven therein.

The invention will be described further by way of example with reference to the accompanying drawings in which.

Figure 4A:
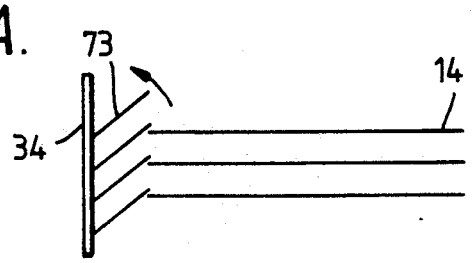
Figure 4B:
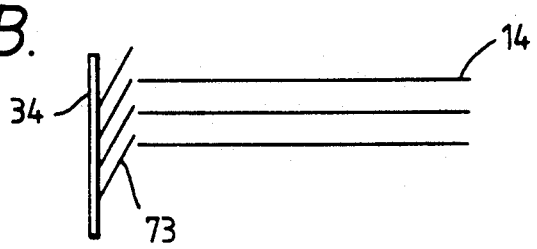
Figure 5:
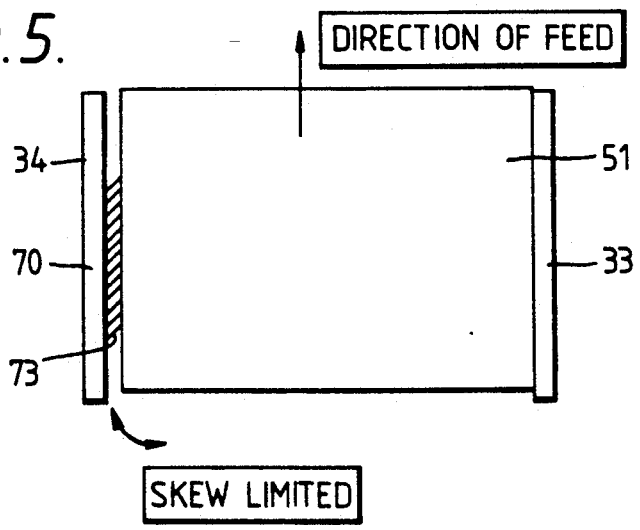

FIGS. 4A and 4B each show schematically a part section through the stack, the sheets in FIG. 4B being larger than the sheets in FIG. 4A; and FIG. 5 shows schematically a plan view of the bristles engaging the edge of the stack.

Figure 1:
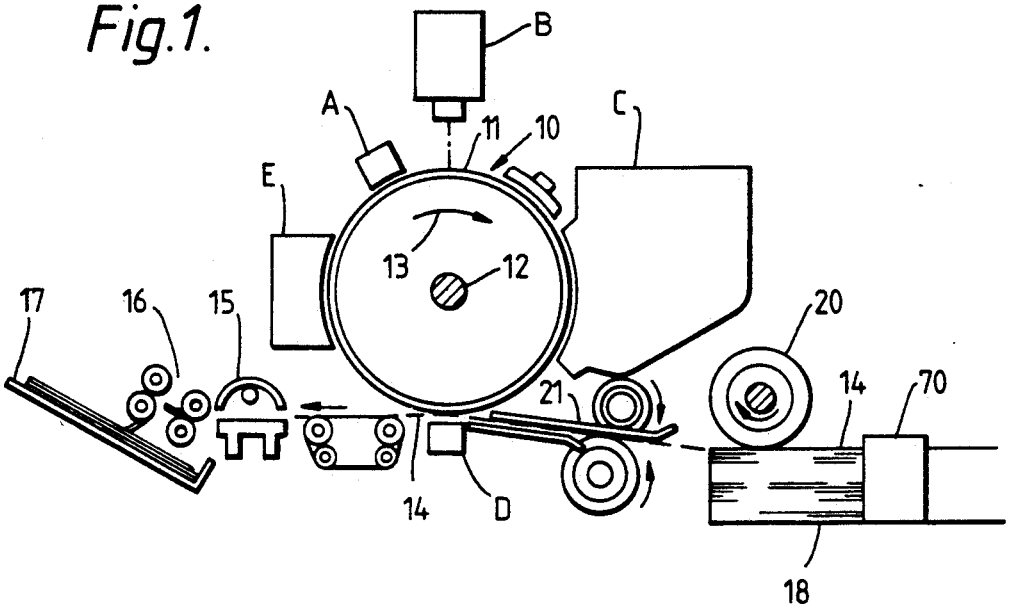
FIG. 1 shows schematically an exemplary xerographic copier with which the sheet feeder of this invention could be employed.

A reproducing machine is depicted schematically in FIG. 1 illustrating the various components utilized therein for producing copies from an original. Although the sheet feeding apparatus of the present invention is particularly well adapted for use in an automatic xerographic reproducing machine it should become evident from the following description that it is equally well suited for use in a wide variety of machines requiring single sheet feeding and is not limited in its application to the particular embodiment shown herein.

The reproducing machine illustrated in FIG. 1 employs an image recording drum-like member 10 the outer periphery of which is coated with a suitable photoconductive material 11. The drum 10 is suitably journaled for rotation within a machine frame (not shown) by means of a shaft 12 and rotates in the direction of arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for reproducing a copy of an original are herein represented in FIG. 1 as blocks A to E. Initially, the drum 10 moves the photoconductive surface 11 through charging station A. At the charging station A an electrostatic charge is placed uniformly over the photoconductive surface 11 of the drum 10 preparatory to imaging. The charging may be provided by a corona generating device.

Thereafter the drum 10 is rotated to exposure station B where the charged photoconductive surface 11 is exposed to a light image of the original input scene information, whereby the charge is selectively dissipated in the light exposed regions to record the original input scene in the form of a latent electrostatic image.

After exposure, drum 10 rotates the electrostatic latent image recorded on the photoconductive surface 11 to the development station C, wherein a conventional developer mix is applied to the photoconductive surface 11 of the drum 10 rendering the latent image visible. The developed image on the photoconductive surface 11 is then brought into contact with a sheet of final support material 14 within a transfer station D and the toner image is transferred from the photoconductive surface 11 to the contacting side of the final support sheet 14. The final support material may be paper, plastic, etc., as desired. The sheet with the image thereon is advanced to a suitable fuser 15 which coalesces the transferred powdered image thereto. After the fusing process, the final support material 14 is advanced by a series of rolls 16 to a catch tray 17 for subsequent removal therefrom by the machine operator. The residual toner particles remaining on the photoconductive surface 11 after the transfer operation are removed from the drum 10 as it moves through the cleaning station E.

The sheets of final support material 14, usually paper sheets, are stored in the machine within a tray 18 which may for example be in the form of a removable paper cassette. The copier may have the capability of accepting and processing copying sheets of varying sizes. The length of the copy sheet, of course, is dictated by the size of the original input scene information recorded on the photoconductive surface 11. In operation, the tray 18 is filled with a stack 19 of paper 14 of pre-selected size and the tray 18 is inserted into the machine by sliding along a base plate (not shown) which guides the tray 18 into operable relationship with a pair of feed rollers 20. When properly positioned in communication with the feed rollers 20 the top sheet of the stack 19 is separated and forwarded from the stack 19 into the transfer station D by means of registration rolls 21.

It is believed that the foregoing description is sufficient for the purposes of the present application to illustrate the general operation of an automatic xerographic copier which can embody the teachings of the present invention.

Figure 2:
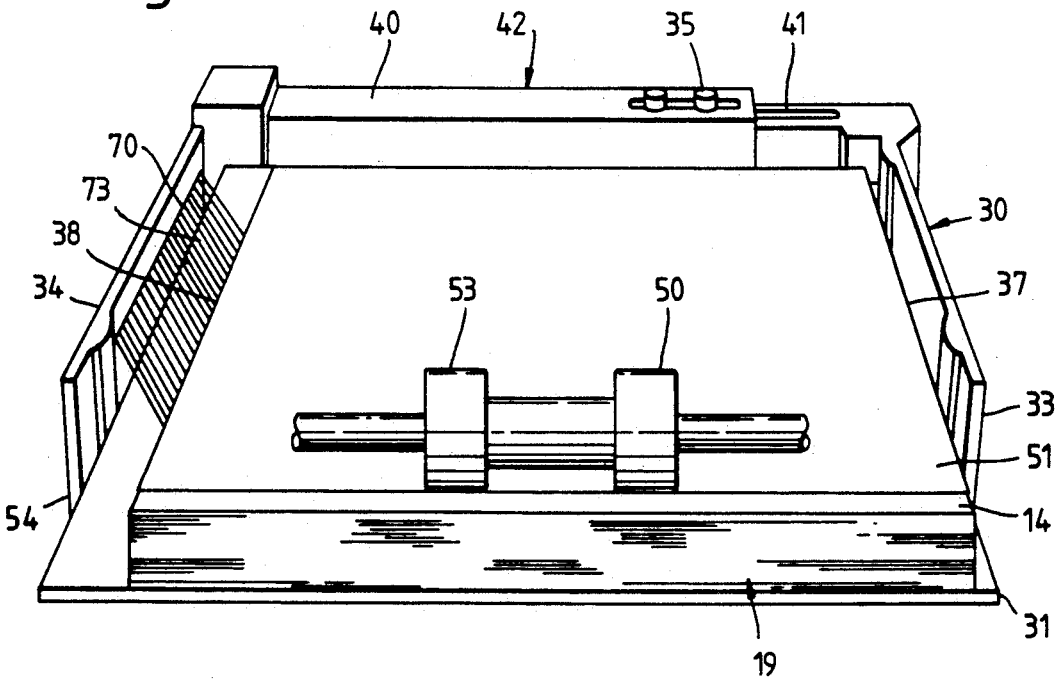
FIG. 2 shows a perspective view of a sheet feeding apparatus in accordance with one embodiment of the invention.

Referring now to FIG. 2, there is shown a sheet feeding apparatus 30 in accordance with one embodiment of this invention. The apparatus 30 includes an adjustable tray 31. The tray 31 includes a bottom portion which is adapted to support the stack 19. Connected to the bottom portion are adjustable side walls 33 and 34 which may be locked in a desired position by any conventional means such as holding screws 35. Each of the side walls 33 and 34 includes a rear wall portion 40 and 41 respectively which cooperate to define the rear wall 42 of the tray 31.

A sheet feeding means 50 is provided which contacts the top sheet 51 of the stack 19 and advances it to station D in FIG. 1. The feeding means 50 may be of any conventional design as are well known in the art. The feeding means 50 shown comprises a pair of feed rolls 53 which are journaled for rotation and driven by conventional means (not shown).

The side wall 34 includes constraining means 70 for removing skew from the sheets in the stack 19. The constraining means 70 comprises a length of cloth 70 with nylon bristles 73 woven into it. The cloth 70 is attached to the side wall 34 so as to define a longitudinally-extending area from which the resilient bristles 73 extend. The bristles 73 stream outwardly from the side wall 34 of the tray 31 in the feed direction, and into contact with a side 38 of the stack 19, to bias the opposing side wall of the stack 19 against the opposing wall 33 of the tray 31. Each bristle 73 acts as an independent spring, so that when they are combined into a sheet, they act together as a sprung wall (see FIG. 3). The bristles 73 are used to limit the movement of the paper in the tray 31 as it is fed, thus minimizing skew (see FIG. 5). Slightly larger sheets of paper (due to paper cutting tolerances) can be accommodated in the tray 31 as the bristles 73 are bent by a greater amount. This effect is illustrated in FIGS. 4A and 4B, the bristles 73 being bent by a greater amount in FIG. 4B so as to accommodate the larger sheets. The limiting of skew in this manner is particularly useful in its application to high capacity feeder designs.

It will be appreciated to those skilled in the art that the function of the bristles in the present invention differs from the function of plastic grass which has been previously used in feeders. The plastic grass holds down the edges of the paper as it is fed out of the tray 31. The grass consists of short hairs (1-2 mm) which stop the edge of the paper riding up the side walls of the tray. This short grass relies on the paper moving to the wall of the tray (in which case some skew may have already occurred).

Figure 3:
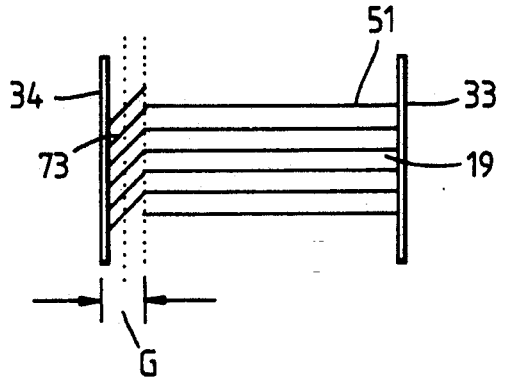
FIG. 3 shows schematically a section through a stack with the bristles engaging the edge of the stack.

In contrast, embodiments of the present invention make use of longer bristles, for example 10 mm, thereby providing a different function. The bristles 73 fill in the space between the wall of the paper cassette/tray and the paper stack 19. This gap G (see FIG. 3) is seen because the tray 31 must be large enough to accommodate the cutting tolerances of the paper. The two dotted lines shown in FIG. 3 illustrate two positions of paper edge depending on paper tolerances. In effect the bristles 73 act as a movable wall. The wall makes up for slight differences in paper size and ensures that the paper stack fits "snugly" into the paper tray 31 (see FIG. 4). By restricting the paper in this way it is possible to minimize skew when the paper feeder is energized. The bristles 73 in effect move the wall to the paper thus eliminating skew.

While the invention has been described in conjunction with specific embodiments thereof, it is evident that many alternatives, modifications, and variations will be apparent to those skilled in the art. For example, although the invention has been described above in relation to its application to a xerographic copier it is equally well suited for use in a wide variety of other machines requiring single sheet feeding such as in printers, or in ATM's in which the apparatus is used for feeding bank notes.

I claim:

1. A sheet supply tray having two walls extending in parallel with the direction from which the sheets are extracted from the tray seriatum, the two walls being spaced an adjustable distance apart to accommodate sheets of different widths, characterized in that one wall comprises a longitudinally-extending area from which resilient bristles project, the free ends of the bristles pointing in the sheet-extraction direction so as to provide a resilient cushion acting on the adjacent sheet edges so to bias the sheets against the opposing wall, to remove any skew therefrom.

2. The sheet supply tray as claimed in claim 1, characterized in that the bristles are more than 2 mm in length.

3. The sheet supply tray as claimed in claim 2, characterized in that the bristles are at least 10 mm in length.

4. The sheet supply tray as claimed in claim 1, characterized in that the bristles are woven into a backing member attached to said one wall of the tray.

5. The sheet supply tray as claimed in claim 4, characterized in that the backing member is a cloth with nylon bristles woven therein.

6. A sheet feeding apparatus including a sheet supply tray having two walls extending in parallel with the direction from which the sheets are extracted from the tray seriatum, the two walls being spaced an adjustable distance apart to accommodate sheets of different widths, characterized in that one wall comprises a longitudinally-extending area from which resilient bristles project, the free ends of the bristles pointing in the sheet-extraction direction so as to provide a resilient cushion acting on the adjacent sheet edges so to bias the sheets against the opposing wall, to remove any skew therefrom.

7. A reproduction machine for placing page image information onto sheets including a sheet supply tray having two walls extending in parallel with the direction from which the sheets are extracted from the tray seriatum, the two walls being spaced an adjustable distance apart to accommodate sheets of different widths, characterized in that one wall comprises a longitudinally-extending area from which resilient bristles project, the free ends of the bristles pointing in the sheet-extraction direction so as to provide a resilient cushion acting on the adjacent sheet edges so to bias the sheets against the opposing wall, to remove any skew therefrom.

8. The reproduction machine of claim 7, characterized in that said bristles of said sheet supply tray are more than 2 mm in length.

9. The reproduction machine of claim 8, characterized in that said bristles of said sheet supply tray are at least 10 mm in length.

10. The reproduction machine of claim 7, characterized in that said bristles of said sheet supply tray are woven into a backing member attached to said one wall of the tray.

11. The reproduction machine of claim 10, characterized in that said backing member of said sheet supply tray is a cloth with nylon bristles woven therein.

* * * * *